United States Patent [19]

Zortman

[11] Patent Number: 4,709,950

[45] Date of Patent: Dec. 1, 1987

[54] CRASH BAR DOOR LOCKING DEVICE

[75] Inventor: Zedekiah Z. Zortman, Steeleville, Ill.

[73] Assignee: American Device Manufacturing Co., Steeleville, Ill.

[21] Appl. No.: 623,032

[22] Filed: Jun. 21, 1984

[51] Int. Cl.[4] ..... E05B 65/10

[52] U.S. Cl. ..... 292/92; 70/92; 292/198; 292/223; 292/224; 292/226; 292/DIG. 65; 292/DIG. 66

[58] Field of Search ..... 70/92, 474, 150, 151 A, 70/151 R, 152; 292/153, 92, DIG. 66, DIG. 59, DIG. 65, 210, 224, 197, 198, 192, 196, 191, 200, 226, 222, 223, 93

[56] References Cited

U.S. PATENT DOCUMENTS

| | | | |
|---|---|---|---|
| 1,430,905 | 10/1922 | Hurd | 292/192 |
| 1,706,486 | 3/1929 | Gasey | 292/169.15 X |
| 2,824,440 | 2/1958 | Jewett et al. | 70/92 |
| 3,335,509 | 8/1967 | Braxton | 40/16 X |
| 3,477,260 | 11/1969 | Balducci et al. | 70/92 |
| 3,705,739 | 12/1972 | Adler | 292/DIG. 66 X |
| 3,819,213 | 6/1974 | Vanderburgh | 70/92 X |
| 4,074,548 | 2/1978 | Milton | 70/1.5 |

FOREIGN PATENT DOCUMENTS

| | | | |
|---|---|---|---|
| 2340580 | 2/1975 | Fed. Rep. of Germany | 292/169.13 |
| 1150986 | 8/1957 | France | 292/153 |
| 575646 | 4/1958 | Italy | 70/143 |
| 2084643 | 4/1982 | United Kingdom | 70/92 |

*Primary Examiner*—Lloyd A. Gall

*Attorney, Agent, or Firm*—Cohn, Powell & Hind

[57] ABSTRACT

A crash bar door locking device is provided, suited for mounting on the inside of a swinging door. The crash bar is mounted horizontally across the door providing ready access by movement in the outside direction. The crash bar activates a pivotal lever which causes a latch bolt to rotate inwardly and disengage from a door strike. The pivotal lever provides a deadbolt feature by preventing the rotation of the latch bolt. A release is incorporated in the latch bolt and allows the latch bolt to rotate when the release engages the door strike as the door closes. An additional unlocking mechanism may be provided for retracting the latch bolt from the outside of the door independently of the crossbar. A fire-locking mechanism may be incorporated in the latch bolt to secure the latch bolt when a fire occurs. Two pins with a spring between them are retained by fusible plugs at either end of a bore in the latch bolt, so that the latch bolt operates as a normal lock on the door. When a fire occurs, the fusible plugs will melt and the pins will go to an extended position in which they interact with a bracket mounted on the door and prevent the latch bolt from disengaging the door strike so that the door will remain closed.

18 Claims, 7 Drawing Figures

CRASH BAR DOOR LOCKING DEVICE

BACKGROUND AND SUMMARY OF THE INVENTION

Applicants are aware of the following U.S. Pat. Nos.

| | |
|---|---|
| Carlson | 3,189,142 |
| Floyd, et al. | 3,811,717 |
| Zawadzki, et al. | 3,854,763 |
| Eads | 3,869,159 |
| Williams | 3,877,262 |
| Erikson | 4,007,954 |
| Salvatore | 4,012,066 |
| Horvath | 4,015,869 |
| Folger | 4,083,590 |
| Allemann | 4,183,565 |
| Kral | 4,311,329 |
| Floyd | 4,384,738 |

The disclosure of the above patents are incorporated herein by reference.

The present invention relates generally to emergency exit locking devices. Prior locking devices have used crash bars, which are generally known in the art. However, some of these locking devices have not incorporated a dead bolt feature. Without this dead bolt feature these doors are not tamper resistant and could be opened from the outside by depressing the bolt using a credit card or the like.

Prior locking devices which have a deadbolt feature require a mechanism separate from the latchbolt to release the door latch and allow the door to close. This requires either a separate or an elongated door strike to engage the release. Locking devices which have incorporated a dead bolt feature have generally been of the rotary type. Although these devices are effective in preventing tampering from the outside, they are not suitable for emergency doors where a quick opening feature is necessary. The use of a crash bar with these rotary devices requires a complex structure for the interaction of the crash bar and the rotary device.

Latch type dead bolt devices have been developed but usually are of a complex structure. For example, one of these devices requires a release mechanism placed below the latch bolt. A completely separate device is required to give the latch a deadlocking feature. Because of this arrangement the locking device has numerous parts and a complex arrangement of springs, levers, arms and other parts.

Certain doors in buildings, such as schools and other public buildings, must remain locked during a fire in order to prevent the spread of fire from fanning the flames. Prior locking arrangements have not been satisfactory because they lock using only a one pin device. If a fire approaches from the side of the door when the single locking pin is engaged, the frame where the locking pin engages may deform and allow the pin to become disengaged, allowing the door to open. Similarily, if a fireman sprays the door with a burst of water the door may deform and the single pin will not keep the door in a locked position.

Another problem has been that many locking devices have fusible material and mechanisms placed within the internal workings of the lock. This requires that the internal workings be carefully designed to accommodate the fusible material and mechanism. Further, because of this proximity, the likelihood of interfering with other parts and the normal operation of the lock is increased.

An additional problem is the placement and orientation of the fusible locking mechanism. Other spring loaded fusible mechanisms have been placed in the horizontal direction. If the spring becomes annealed during the fire, the fusbile mechanism has no change of operating. Further, because of this horizontal orientation, the fusible locking mechanism requires placement on the bolt at a relatively long distance from a bolt guide. If a fireman sprays the door with a burst of water, the bolt guide may act as a pivot point, the distance will serve to amplify the force, and the locking mechanism will shear, allowing the door to open.

This invention solves these problems and provides a door locking device having fewer parts (and is thus more economical to manufacture) and a simpler operation. When the crash bar is pressed a lever pivots in a clockwise direction. An arm on the lever contacts a latch bolt causing it to rotate counterclockwise. When the latch bolt is rotated, it will clear the strike on the door jam, and permit the door to open. When the crash bar is released, a spring urges the lever to a normal position where the latch bolt is extended outward and the lever is in an unrotated position. In this normal position, the latch bolt is prevented from counterclockwise rotation by the same lever, thus providing the dead bolt feature.

A release mechanism is incorporated in an opening in the latch bolt. After the door is opened and the crash bar is released, the door will swing toward a closing position. The release mechanism will strike the door first and cause the lever to rotate slightly so that the latch bolt is no longer dead locked. The door can then proceed to a fully closed position where the lever returns to the normal position as described above.

A fusible locking device is provided which is activated when a fire occurs. A vertical transverse bore in the latch bolt contains two pins biased against each other by a spring placed between them. The pins are restricted at either end of the bore by fusible plugs. With the plugs in place, the latch bolt will slide freely resulting in normal lock operation. When a fire occurs, both fusbile plugs will melt and the pins, because of the spring bias, will move to an extended position. In this extended position the pins are inserted in a frame attached to the door. The pins are constrained, so as not to extend further, by stops mounted on the frame. When the pins are in the extended position the bolt will not move, thus preventing the door from opening. Should the spring become annealed by the fire, the fusible plug in the bottom will melt and the lower pin will move into the frame due to its own weight, as well as the weight of the spring and upper pin.

DETAILED DESCRIPTION OF THE PREFERRED EMBODIMENT

Figure 1:
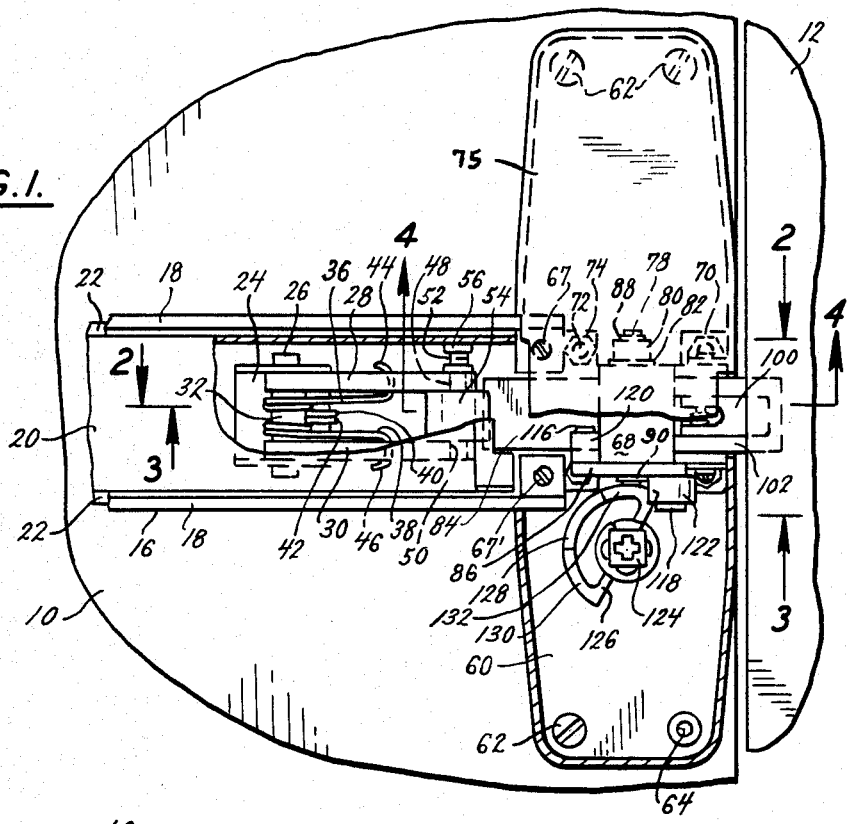
FIG. 1 is a side elevation of a crash bar type latch lock partially broken away showing the operating portions.

As shown in FIG. 1, a door 10 swings in door frame 12. Door frame 12 has a latch recess or strike 14. A mounting frame 16 is attached to door 10 and is generally U-shaped with a lip 18 curved inward. Bar 20 is slidably engaged with frame 16 and has a lip 22 curved outward which interacts with lip 18 to keep the movement of bar 20 constrained. Bracket 24 is mounted to the frame 16 by welds (not shown). Bracket 24 is shaped to accommodate a pin 26 which is retained by clips (not shown) at either end. Levers 28 and 30 are separated by a spacer 32. Each of levers 28 and 30 have a bore (not shown) which accommodates the pin 26 allowing the levers 28 and 30 to pivot.

Figure 2:
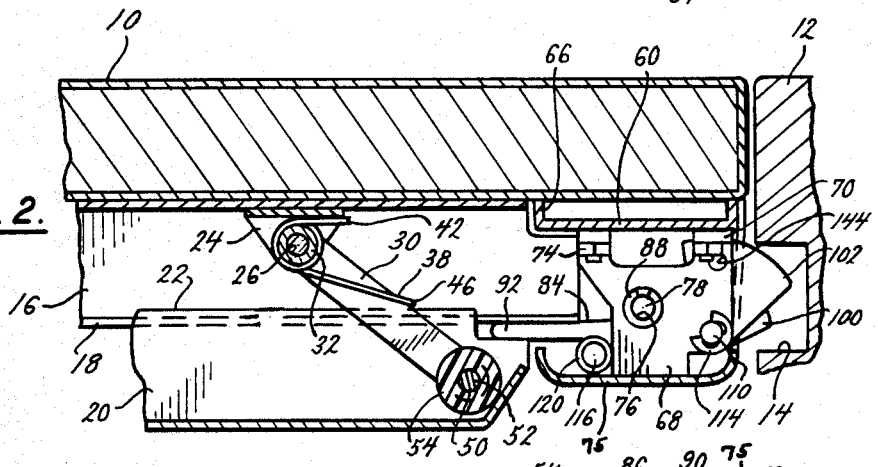
FIG. 2 is a cross section along the plane of line 2—2 of FIG. 1.

Springs 36 and 38 are coiled around spacer 32 and have ends 40 and 42 respectively which press against bracket 24. At the opposite end of springs 36 and 38 are loops 44 and 46 respectively curving around levers 28 and 30. Springs 36 and 38 bias these levers in a clockwise direction, as shown in FIG. 2, by a spring force against frame 24.

At the ends of levers 28 and 30, opposite pin 26, are bores 48 and 50 respectively through which pass pin 52. A roller 54 placed between levers 28 and 30 rotates on pin 52. A threaded bolt 56 is inserted in a threaded bore in pin 52. Bar 20 has two bores (not shown) which align with pin 52. When threaded bolt 56 is unscrewed, so as to expose more of its threads, the head of bolt 56 is pressed into and engages one of the bores. The opposite end of pin 52 similarly presses into and engages the other bore. Bar 20 is thus attached to pin 52 so that the movement of bar 20 will move pin 52.

Figure 4:
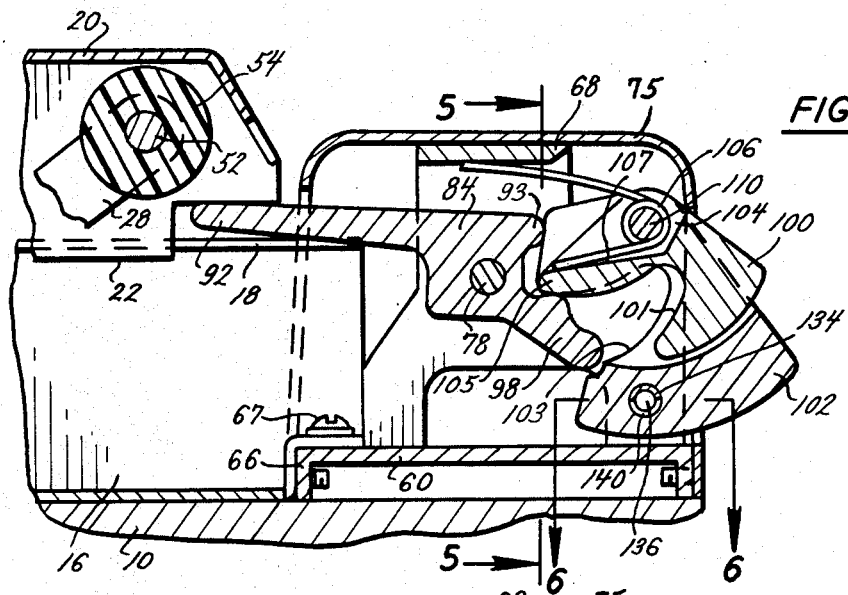
FIG. 4 is a cross section along the plane of line 4—4 of FIG. 1 showing the latch in a locked position.

A plate 60 is secured to door 10 by screws 62, each in a bore in plate 60 similar to bore 64. Plate 60 has a lip 66 around its periphery and, on one side frame 16 is secured to plate 60 by two screws 67 and 67′, as shown. A generally U-shaped frame 68 is mounted with the open side against the door 10 and has four mounting feet 70. Frame 68 is secured to plate 60, as shown. At each foot 70 a threaded bolt 72 passes from the back of plate 60 through foot 70 and is secured by nut 74. Plate 60 and frame 68 may have a cover 75 which is fastened by conventional means as shown in FIGS. 1 and 4.

Frame 68 has a bore 76 which accommodates a pin 78. Pin 78 passes through a nylon bushing 80, a lock washer 82, the top of frame 68, a lever 84, the bottom of frame 68 and bar 86, as shown. Pin 78 has grooves at either end into which are inserted split ring retainers 88 and 90 which secure the pin 78 to frame 68.

Lever 84 pivots on pin 78. Lever 84 has a raised portion 93 and a flat arm portion 92. Lever 84 has a second arm 98 which is in contact with a trip latch 100 and a locking latch 102, as shown.

Figure 7:
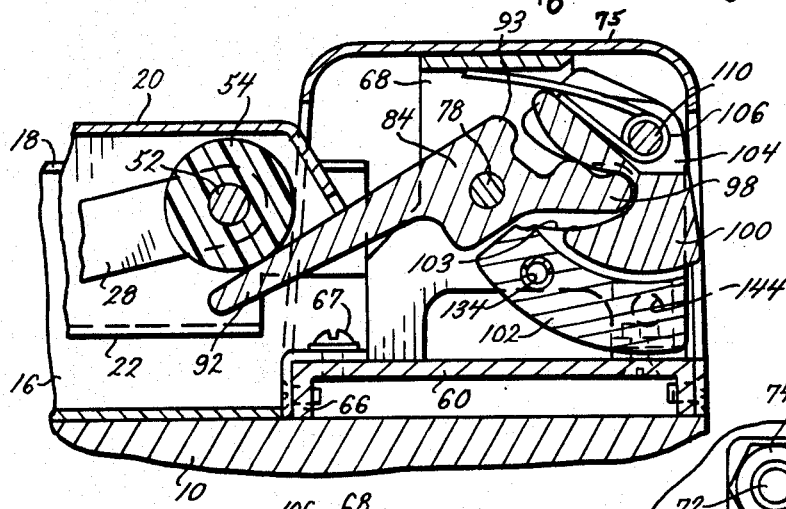
FIG. 7 is a cross section similar to FIG. 4 showing the latch in an unlocked position.
Figure 5:
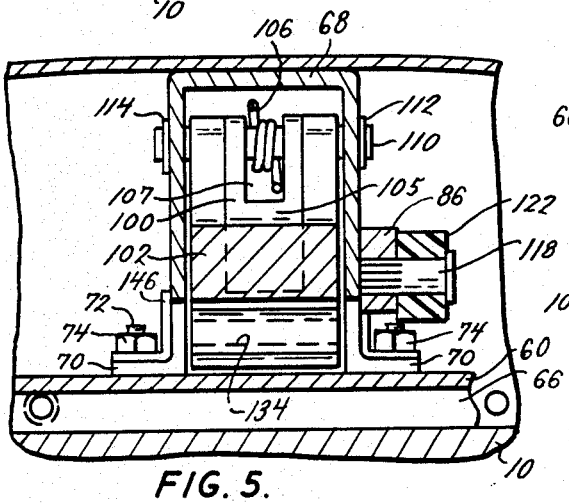
FIG. 5 is a section along the plane of line 5—5 of FIG. 4.

Locking latch 102 has an opening 104 which is occupied by trip latch 100. A spring 106 acts between frame 68 and a flattened portion 107 of trip latch 100. Both trip latch 100 and locking latch 102 have inside edges 101 and 103 respectively, which contact the arm 98 when the lock is in the open position, as shown in FIG. 7. Trip latch 100 also has an inner portion 105 which contacts the arm 98 when the lock is in the normal position, as shown in FIG. 4.

Both trip latch 100 and locking latch 102 rotate on a pin 100. Pin 110 passes through the top of frame 68, locking latch 102, trip latch 100, spring 106 and the bottom of frame 68. Pin 110 has grooves at either end into which are inserted split ring retainers 112 and 114 which secure the pin 110 to frame 68.

Figure 3:
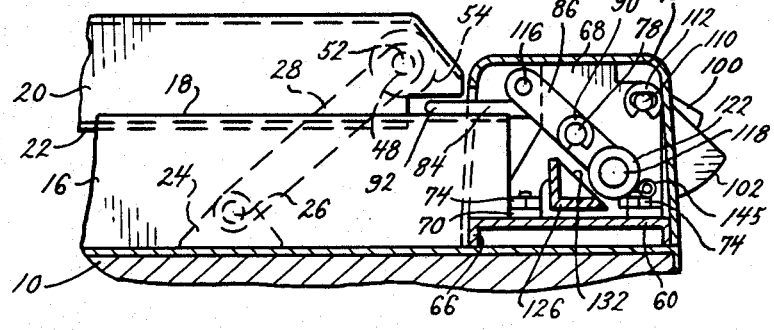
FIG. 3 is a cross section along the plane of line 3—3 of FIG. 1.

Bar 86 pivots on pin 78 and has a bore at either end into which driveable studs 116 and 118 are secured, said studs passing through nylon rollers 120 and 112 respectively. (See FIGS. 1 and 3). A stud 124 passes through a bore in plate 60 and accommodates a semi-circular member 126. Semi-circular member 126 rotates on stud 124 and has a raised portion 128 and sloped portions 130 and 132.

Figure 6:
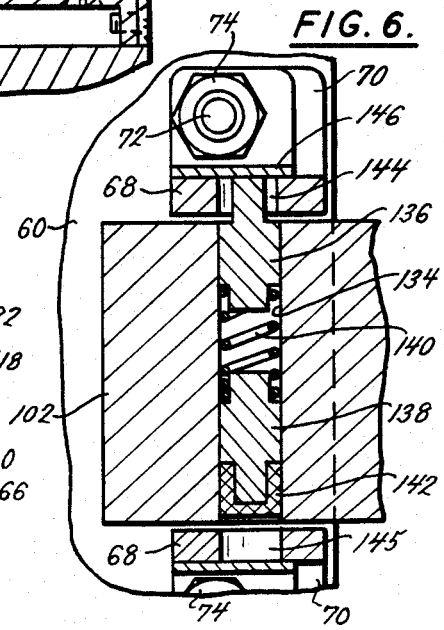
FIG. 6 is section along the plane of line 6—6 of FIG. 4 showing the detail of the fusible locking device.

Latch bolt 102 has a bore 134 which accommodates pins 136 and 138 (See FIGS. 4 and 6). A spring 140 placed between pins 136 and 138 loops around the end of each of these pins. The spring 140 biases pins 136 and 138 to move outward. A fusible plug 142 is frictionally engaged at the end of bore 134 and constrains pin 138. The fusible plug 142 may be engaged by being press fit into the bore 134 or by matching threads (not shown) on the plug 142 and bore 134. A similar fusible plug (not shown) also normally constrains pin 136. As shown in FIG. 6, pin 136 has moved to this outward position inserted in opening 144 in frame 68. A stop 146 attached to frame 68 restricts the movement of pin 136.

OPERATION OF THE DEVICE

When the door is in the closed position the locking latch 102 engages the latch recess 14 to prevent the door from opening, as shown in FIG. 2. The trip latch 100 is extended outwardly by spring 106. Flat portion 92 is maintained in this normal position by the action of spring 106. Arm 98 is positioned adjacent locking latch 102 and prevents the locking latch from moving inwardly by tampering from the outside by a credit card or the like. Trip latch 100 has its inner portion 105 pressed against arm 98 due to the spring action of spring 106.

When the bar 20 is pushed, levers 28 and 30 pivot in a counterclockwise direction, as shown in FIG. 2. When enough pressure is exerted to overcome the spring action of springs 36 and 38, roller 54 will press against flat portion 92. As flat portion 92 is pressed, the arm 98 will rotate out of its position adjacent to locking latch 102, acting against the spring action of spring 106. As flat portion 92 rotates further, arm 98 presses against inner portion 105 and causes locking latch 102 and trip latch 100 to rotate inwardly out of engagement with latch recess 14 until both latches are fully retracted, as shown in FIG. 7. The door can then be opened.

When bar 20 is released, roller 54 moves due to the spring action of spring 36 and 38. As lever 84 rotates in response of the spring action of spring 106, arm 98 moves against locking latch 102 on its inside edge 103 and trip latch 100 on its inside edge 101, forcing these latches to an outward position, as shown in FIG. 4.

As the door swings toward a closed position, trip latch 100 will contact doorframe 12 causing the trip latch to move inward. When trip latch 100 moves inward, its inner portion 105 pushes against lever 84 at raised portion 93 causing flat portion 92 to rotate slightly so that arm 98 does not prevent locking latch 102 from moving inward. Trip latch 100 then pushes against locking latch 102, resulting in both latches moving inward. Arm 98 presses against the latches as they move inward, causing the flat portion 92 to rotate.

Spring 106 continues to bias flattened portion 107 so that arm 98 will apply pressure outwardly to both latches. When the door closes sufficiently, locking latch 102 will move into latch recess 14. Trip latch 100 also moves outwardly and the door lock returns to the normal position, as shown in FIG. 4.

The door lock may also be operated from the outside of the door. Semi-circular member 126 is rotated by movement of stud 124. A key and tumbler mechanism (not shown) may be mounted on the outside of the door to allow rotation of stud 124. As stud 124 rotates in a clockwise direction, semi-circular member 126 rotates and sloped portion 132 moves under roller 122 (see FIG. 1). The roller 122 is raised, causing bar 86 to pivot. As bar 86 pivots, roller 120 is pushed against flat portion 92 causing the lever 84 to rotate in the same manner as described above. When the stud 124 is rotated in a counterclockwise direction, spring 106 urges lever 84 to return to a normal position. Roller 120 moves in response to the movement of flat portion 92 causing the bar 86 to rotate and roller 122 to move back to its original position.

Should a fire occur, the heat will cause fusible plug 142 and the other plug (not shown) to melt. Pins 136 and 138 will move, due to the biasing of spring 140, into openings 144 and 145 in frame 68. If spring 140 should become annealed pin 38 will move downward in vertical bore 134 due to the weight of pins 136 and 138, and spring 140 thus, placing pin 138 in opening 145. The locking latch 102 will not move, even with a force placed on flat portion 92. Pins 136 and 138 are normally constrained by plug 142 and the other plug, not shown, permitting locking latch 102 to move freely in frame 68.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A door latch having a fire safety locking mechanism, to secure the latch in a locked position upon release of said safety lock mechanism, wherein the door latch has a latch bolt and a mounting bracket, the latch bolt having a transverse bore and the bracket having two transverse holes therein, the bracket being located on the door latch with the bore opening in alignment with the holes in the bracket, the latch bolt having two slidably received in the bore, each pin being biased against the other pin by a means for biasing located between the pins, the pins and the biasing means being retained in a compressed position by two plugs of fusible material frictionally engaged at either end of the bore to restrain the pins and biasing means in a compressed position out of engagement with the holes, whereby when the locking mechanism is exposed to heat sufficient to melt the fusible plugs, the pins are released and engage the holes in the bracket, securing the latch bolt in the locked condition.

2. The door latch of claim 1 further comprising stops mounted on the bracket which restrain the pins when they engage the holes so that the pins do not extend beyond the bracket.

3. The door latch of claim 1 wherein the means for biasing the pins is a coil spring.

4. The door latch of claim 3 wherein the pins each have a shoulder onto which the spring is coiled.

5. The door latch of claim 1 wherein the transverse bore in the latch bolt is vertical when the door latch is mounted on a door.

6. The door latch of claim 1 wherein said fusible plugs are engaged in the bore by a press fit.

7. A door latch adapted to be mounted on a door for selective engagement with a door strike, the door latch comprising a frame, a latch bolt supported on the frame for selective, pivotal movement outwardly to engage a door strike and inwardly to disengage the door strike, the latch bolt, when extended outwardly, substantially engaging the cooperating door strike to retain a door on which the latch is mounted in a locked position, the door latch having a release within the latch bolt, means for biasing the release outwardly from the latch bolt, and a deadlocking means having a first position preventing inward movement of the latch bolt and a second position at which the latch bolt is permitted to pivot inwardly and clear the deadlocking means, whereby when the latch is mounted on a door, the release will engage the strike on closing, causing the release to move inwardly, forcing the disengagement of the deadlocking means and forcing inward pivotal movement of the latch bolt by the release permitting the latch bolt to clear the door strike.

8. The door latch of claim 7 further comprising a fire safety locking mechanism, to secure the latch in a locked position upon release of said safety lock mechanism, wherein the door latch has a mounting bracket, the bracket having a transverse hole and the latch bolt having a transverse bore therein, the bracket being located on the door latch with the hole opening in alignment with the bore in the latch bolt, the latch bolt having a pin slidably received in the bore, the pin being biased outwardly by a biasing means, the pin and the biasing means being retained in a compressed position by a plug of fusible material frictionally engaged at the end of the bore adjacent to the bracket hole to restrain the pin and biasing means in a compressed position out of engagement with the hole, whereby when the locking mechanism is exposed to heat sufficient to melt the fusible plug, the pin is released and engages the hole in the bracket, securing the latch bolt in the locked condition.

9. The latch of claim 7 wherein the latch includes a fire safety locking mechanism.

10. The latch of claim 9 wherein the fire safety locking mechanism includes a pin biased by a spring, the pin being held in a normal position by a fusible plug and operable, on melting of the fusible plug, to be moved to a locking position to lock the latch.

11. A door latch adapted to be mounted on a door for selective engagement with a door strike, the door latch comprising a frame, a latching means supported on the frame for selective pivotal movement outwardly to engage a door strike and inwardly to disengage the door strike, the latching means having an extendable pivotal latch bolt which, when extended outwardly, substantially engages the cooperating door strike to retain a door on which the latch is mounted in a locked position, the latch bolt having an opening therein, a release inserted in the opening in the latch bolt, means for biasing the release outwardly from the latch bolt, a lever pivotally supported on the frame and engaging the latch bolt, the lever having a normal position at which the lever prevents inward movement of the latch bolt and a depressed position at which the latch bolt is forced inwardly by the lever to clear the strike, the lever having a means for biasing the lever to the normal position, the release engaging the strike on closing of a door on which the door latch is mounted, moving the release inwardly to engage the lever, forcing the lever out of the normal position, allowing inward pivotal movement of the latch bolt and permitting the latch bolt to clear the door strike.

12. The door latch of claim 1 further comprising means for remotely operating the lever, said means having a mounting bracket secured to the door adjacent the lever, a bar slideably engaged in the mounting bracket so that when the bar is pressed the lever is contacted and will move to its depressed position.

13. The door latch of claim 12 further comprising means for biasing the bar so that the bar will not make contact with the lever until the bar biasing means is overcome.

14. The latch of claim 13 wherein the bar includes means to pivot into engagement with the lever, when the bar is operated.

15. The latch of claim 14 wherein the bar includes means, as the bar is pushed and depressed, to pivot inwardly into engagement with the lever while the bar slides in the mounting bracket.

16. The door latch of claim 11 further comprising an unlocking means so that the lever can be moved from the normal position to the depressed position from the outside of the door.

17. The door latch of claim 16 wherein said unlocking means comprises a means for rotating a post from the outside of the door, said post extending from the outside to the inside of the door, a semicircular member attached securely to the post and having a sloped portion, a pivotal arm mounted on the frame that responds on one end to the sloped portion upon rotation of the semicircular member, so that the other end of the arm presses the lever to unlock the latch bolt.

18. The door latch of claim 11 further comprising a fire safety locking mechanism, to secure the latch in a locked position upon release of said safety locking mechanism, wherein the door latch has a mounting bracket, the bracket having transverse holes and the latch bolt having a transverse bore therein, the bracket being located on the door latch with the holes opening in alignment with the bore in the latch bolt, the latch bolt having two pins slidably received in the bore, each pin being biased against the other pin by a means for biasing located between the pins, the pins and the biasing means being retained in a compressed position by two plugs of fusible material frictionally engaged at either end of the hole to restrain the pins and biasing means in a compressed position out of engagement with the holes, whereby when the locking mechanism is exposed to heat sufficient to melt the fusible plugs, the pins are released and engage the holes in the bracket, securing the latch bolt in the locked condition.

* * * * *